US006472997B2

(12) United States Patent
Leen

(10) Patent No.: US 6,472,997 B2
(45) Date of Patent: Oct. 29, 2002

(54) TOUCH PAD, LED MOTION DETECTOR HEAD

(76) Inventor: Monte A. Leen, 11730 NE. 12th St., Bellevue, WA (US) 98005

( * ) Notice: Subject to any disclaimer, the term of this patent is extended or adjusted under 35 U.S.C. 154(b) by 0 days.

(21) Appl. No.: 09/928,035

(22) Filed: Aug. 11, 2001

(65) Prior Publication Data

US 2002/0030593 A1 Mar. 14, 2002

Related U.S. Application Data

(60) Provisional application No. 60/224,858, filed on Aug. 11, 2000.

(51) Int. Cl.[7] ..... G08B 5/22

(52) U.S. Cl. ..... 340/815.45; 340/815.65; 340/541; 340/565

(58) Field of Search ..... 340/815.45, 815.65, 340/540, 541, 567, 573.1, 573.2, 565, 693.5, 506, 568.8, 326, 321; 362/276, 394, 419, 421, 802

(56) References Cited

U.S. PATENT DOCUMENTS

| | | | | | |
|---|---|---|---|---|---|
| 5,619,182 | A | * | 4/1997 | Robb | 340/479 |
| 5,699,054 | A | * | 12/1997 | Duckworth | 340/825.22 |
| 5,867,099 | A | * | 2/1999 | Keeter | 340/567 |
| 5,892,446 | A | * | 4/1999 | Reich | 340/573.1 |
| D438,133 | S | | 2/2001 | Leen | D10/106 |

* cited by examiner

*Primary Examiner*—Anh La
(74) *Attorney, Agent, or Firm*—Dean A. Craine

(57) ABSTRACT

An improved motion detector head that includes a passive motion sensor with "test," "sensitivity" and "timer" adjustable functions, mounted inside an outer housing with two water-resistant touch-operated membrane switches used to control these settings. Also mounted on the sides of the outer housing and connected to the motion sensor are at least two bright LED lights designed to illuminate in one of three possible colors to visually indicate the current "test", "sensitivity" or "timer" setting of the motion detector.

8 Claims, 4 Drawing Sheets

TOUCH PAD, LED MOTION DETECTOR HEAD

This is a utility patent application based on a provisional patent application (Ser. No. 60/224,858) filed on Aug. 11, 2000.

BACKGROUND OF THE INVENTION

1. Field of the Invention

This invention pertains to infrared motion detectors, and more particularly, to motion detectors with improved time and sensitivity controls for easy use.

2. Description of the Related Art

Infrared motion detectors typically have three manual controls that enable a user to: (1) test the area of coverage, (2) adjust the length of time the light stays "on" after motion is no longer detected, and; (3) adjust the motion detector infrared sensors' sensitivity to heat and motion. Typically, these controls are dial or slide switches externally mounted on the bottom or back surface of the motion detector outer housing.

Many users mount their detectors outdoors under an eave or overhang so that they are less visible to viewers entering the coverage area. Manufacturers generally prefer that the detector be mounted in these locations because they are less likely to contact rain or snow, which can enter the dial or slide switches and cause electrical shorts. Unfortunately, some users must mount their detectors on open, unprotected walls.

It is well known that when the detector is mounted under an eave or overhang, the dial or slide switches are difficult to see with an unaided eye. Because the detectors are typically mounted at an elevated location on the wall, users often must stand on a step ladder with a flashlight in their hands or mouth to make any adjustments to the detector. Even though a detector may be mounted in a protected area, ambient moisture eventually enters the detector. through the dial or slide switches causing corrosion o What is needed is an improved motion detector head with controls that are easier to see and operate and which is less susceptible to damage caused by direct water contact or moisture.

SUMMARY OF THE INVENTION

It is an object of the present invention to provide an improved motion detector head with controls that are easy to see and operate.

It is also an object of the present invention to provide such a motion detector head that is less susceptible to damage caused by direct water contact or moisture.

These and other objects of the invention which will become apparent are met by an improved motion detector head with touch activated switches, mounted on the side of the head that are used to test and control the area of coverage; control the amount of time the lights are activated after motion is no longer detected; and to control the sensitivity to heat and motion.

More specifically, the motion detector head includes a standard, passive-type infrared motion sensor with manually operated controls used to bypass the sensor detector, for basting the range of sensitivity and to program the sensitivity and timer settings. At least two membrane switches are provided that control the motion sensor "sensitive" and "timer" settings. Connected to the motion sensor basting and timing circuits are LED lights that illuminate in one of three possible colors to indicate the current sensitivity and timer setting of the motion sensor. The motion detector may also include an optional photocell eye that automatically senses brightness, thereby preventing the sensor from activating the lamps in the daytime.

DESCRIPTION OF THE PREFERRED EMBODIMENT(S)

Figure 1:
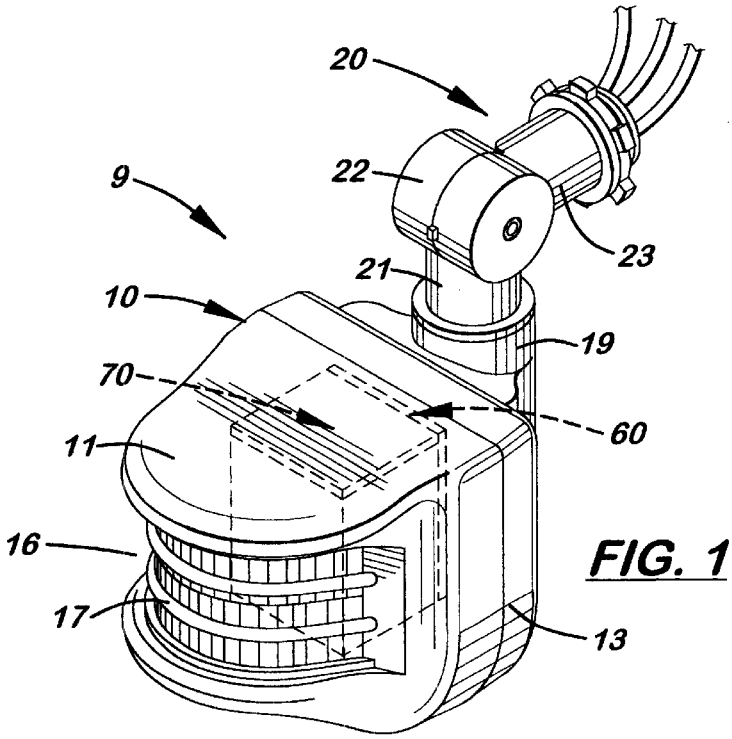
FIG. 1 is a perspective view of the motion detector head disclosed herein.

Referring to the accompanying figures, there is shown and described an improved motion detector 9 designed to be easier to use and more water resistant. The motion detector 9 includes an outer housing 10 attached to adjustable electrical conduit 20 designed to be attached to a standard electrical box (not shown). The motion detector 9 includes a standard passive, 110-volt motion sensor 70 housed inside the rigid outer housing 10. The motion detector 9 includes a printed circuit board 60 to which a main switch 42. Two touch-activated, membrane style switches 44,46 and two LED's 50, 55 are attached as discussed further below.

The outer housing 10 includes a downward curved top surface 11, a bottom surface 12, two side surfaces 13, 14, a rear surface 15, a front opening 16 covered with a partially transparent lens 17, and an upward curved front surface 18. Formed on the upper portion of the rear surface 15 is a cylindrical neck 19, designed to connect to a vertically aligned conduit tube 21. The distal end of the conduit tube 21 is connected to a joint 22 that connects to a horizontal conduit 23 that, in turn, connects to an electrical box.

In the preferred embodiment, the motion sensor 70 includes a "test" function, an adjustable sensor sensitivity feature, and an adjustable "timer" function. The "test" function is used to by-pass the optional photocell 80 connected to the motion sensor 70 so that the motion sensor circuit is activated whenever motion is detected in its field of view. The "test" function is used primarily during setup to allow the user to adjust the motion sensor's sensitivity and timer functions during daylight conditions. The adjustable sensor sensitivity feature function is used to adjust the motion sensor's sensitivity to a moving infrared emitting source. Using this feature, the user is able to increase or decrease the amount of heat needed to activate the sensor.

The "timer" function is used to adjust the amount of time the outside circuit remains open after the infrared emitting source has left the target area. In the preferred embodiment, the motion sensor 70 has three possible time intervals —1 minute, 5 minute, and 10 minute.

Figure 2:
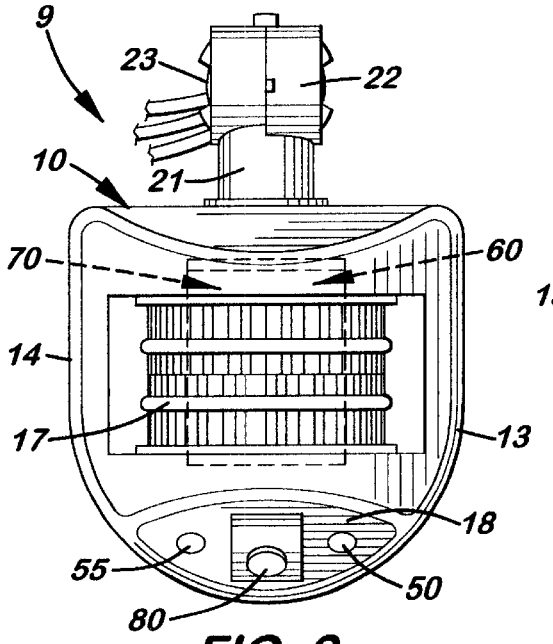
FIG. 2 is a front elevational view of the invention.

As shown in FIG. 2, mounted on the front surface 18 below the front opening 16 and lens 17, are two LED's 50, 55. In the preferred embodiment, the LED's 50, 55 are both capable of illuminating in RED, ORANGE, and GREEN colors. The LED's 50, 55 are electrically connected to the circuit board 60 used to indicate one or more functional status of the motion, sensor 70 as discussed further below.

Figure 3:
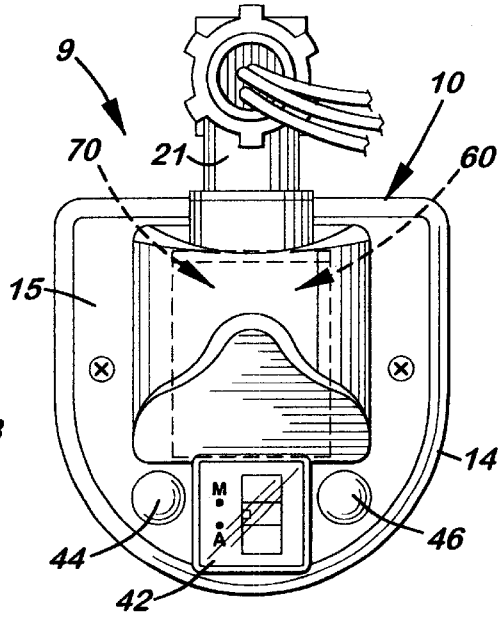
FIG. 3 is a rear elevational view of the invention.
Figure 4:
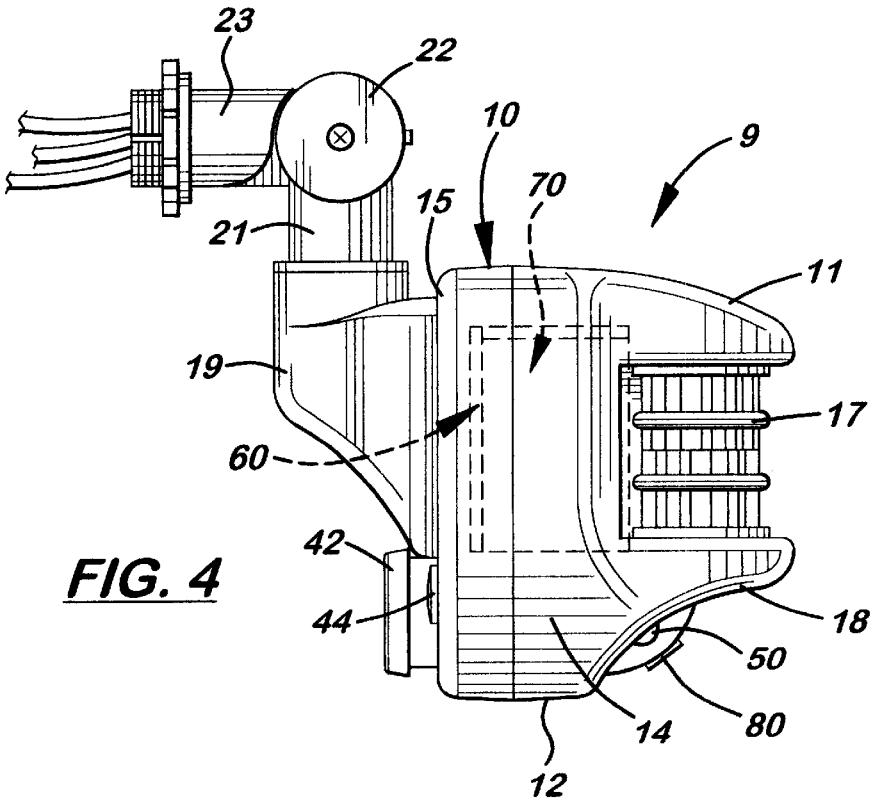
FIG. 4 is a left side elevational view of the invention.
Figure 5:
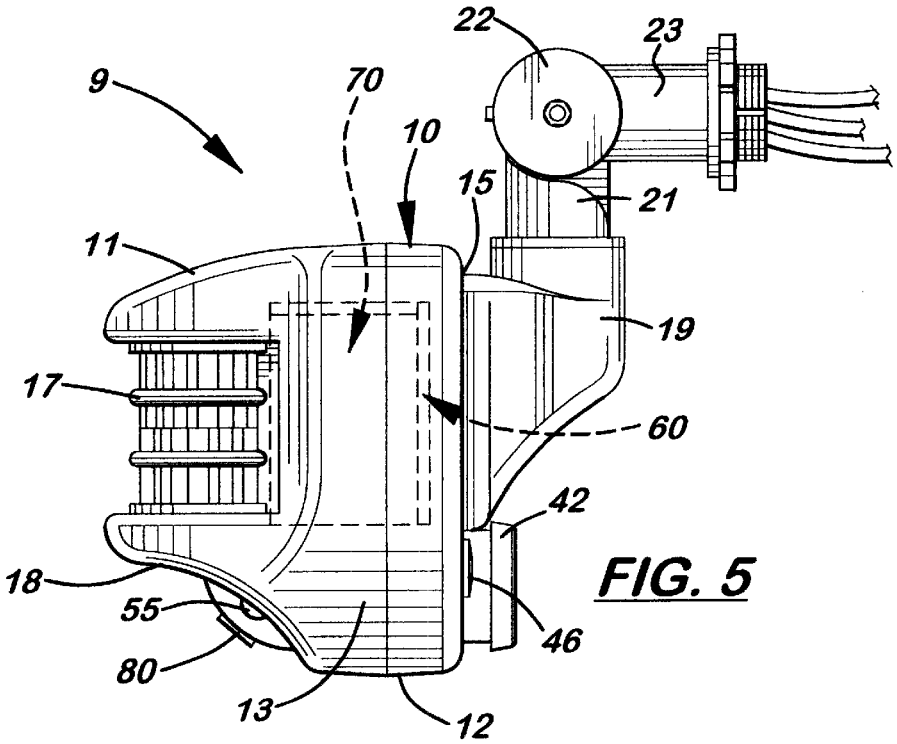
FIG. 5 is a right side elevational view of the invention.
Figure 6:
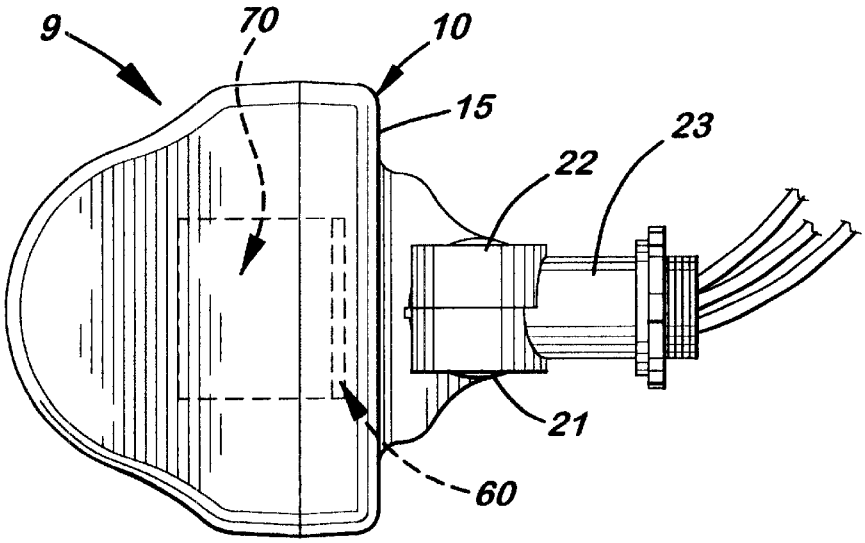
FIG. 6 is a top plan view of the invention.
Figure 7:
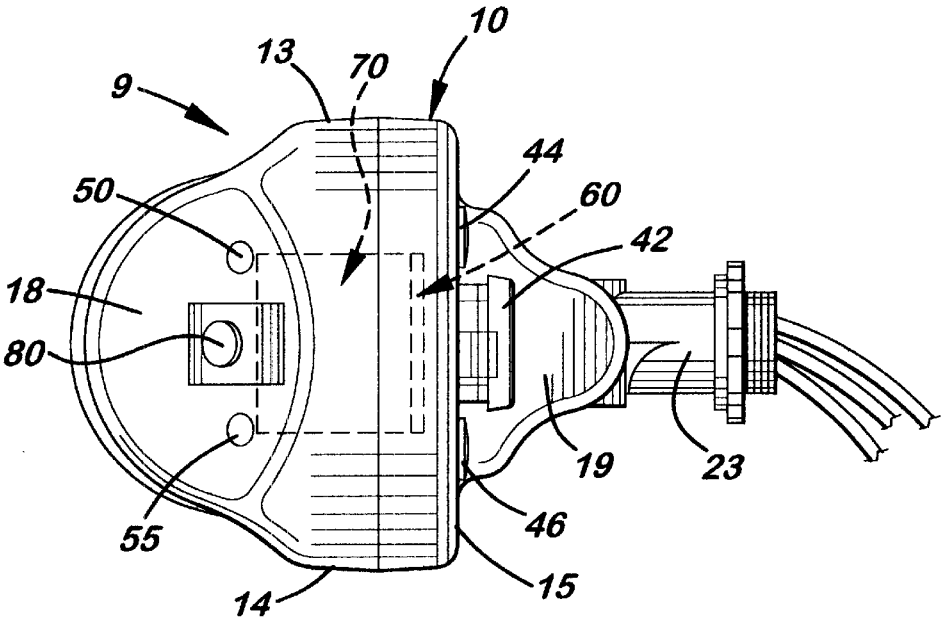
FIG. 7 is a bottom plan view of the invention.

As shown in FIG. 3, mounted on the lower portion of the rear surface 15 is a main switch 42 and a first, touch-activated switch 44 located on one side and a second touch-activated switch 46 located on the opposite side. The main switch 42, the two touch-activated switches 44, 46 and the two LED's 50, 55 are all connected to the circuit board 60 so that three possible colors on the two LEDs 50, 55 are used to visually indicate the current setting or functioning status of the motion sensor 70. During use, the main switch 42 is manually set to one of three possible positions: Off (indicated as DD), Range Bast (indicated as RB) and Automatic (indicated as Auto). When the main switch 42 is turned to "Auto", the first LED 50 changes to one of three possible colors according to the current one of the three possible sensitivity states —high sensitivity (Red), medium sensitivity (Orange) and low sensitivity (Green). The first touch-activated switch 44 located on the rear surface 15 may then be used to change the motion sensor's sensitivity. When the sensitivity is changed the first LED 50 changes its illumination. When the main switch 42 is also turned to the "Auto" position, the second LED 55 changes to one of three possible colors and is used to indicate one of three possible time periods the motion sensor 70 will remain activated after an infrared emitting object leaves the viewing zone of the motion sensor 70: one minute (Red), 5 minutes (Orange) and 10 minutes (Green). The second touch-activated switch 46 is used to cycle through the time periods until the desired time period is selected with the second LED 55 changing color with each new setting.

The main switch 42 also includes an optional "DD" position, which allows the motion sensor 70 to be turned off completely. This is used when a photocell is attached to the circuit, which may be used to provide "dusk-to-dawn" operation, coming on at dusk and going off at dawn. By moving the main switch 42 to the "RB" position at which objects are detected is increased.

By using both the two touch —activated switches 44, 46 and two LED's 50, 55, the motion detector 9 is easier to use because the switches are touch activated and do not require tools and the LED's 50, 55 lights provide visual feedback to the user of motion sensor's current settings. The touch-activated switches 44,46, being membrane switches, are also more water resistant.

Figure 8:
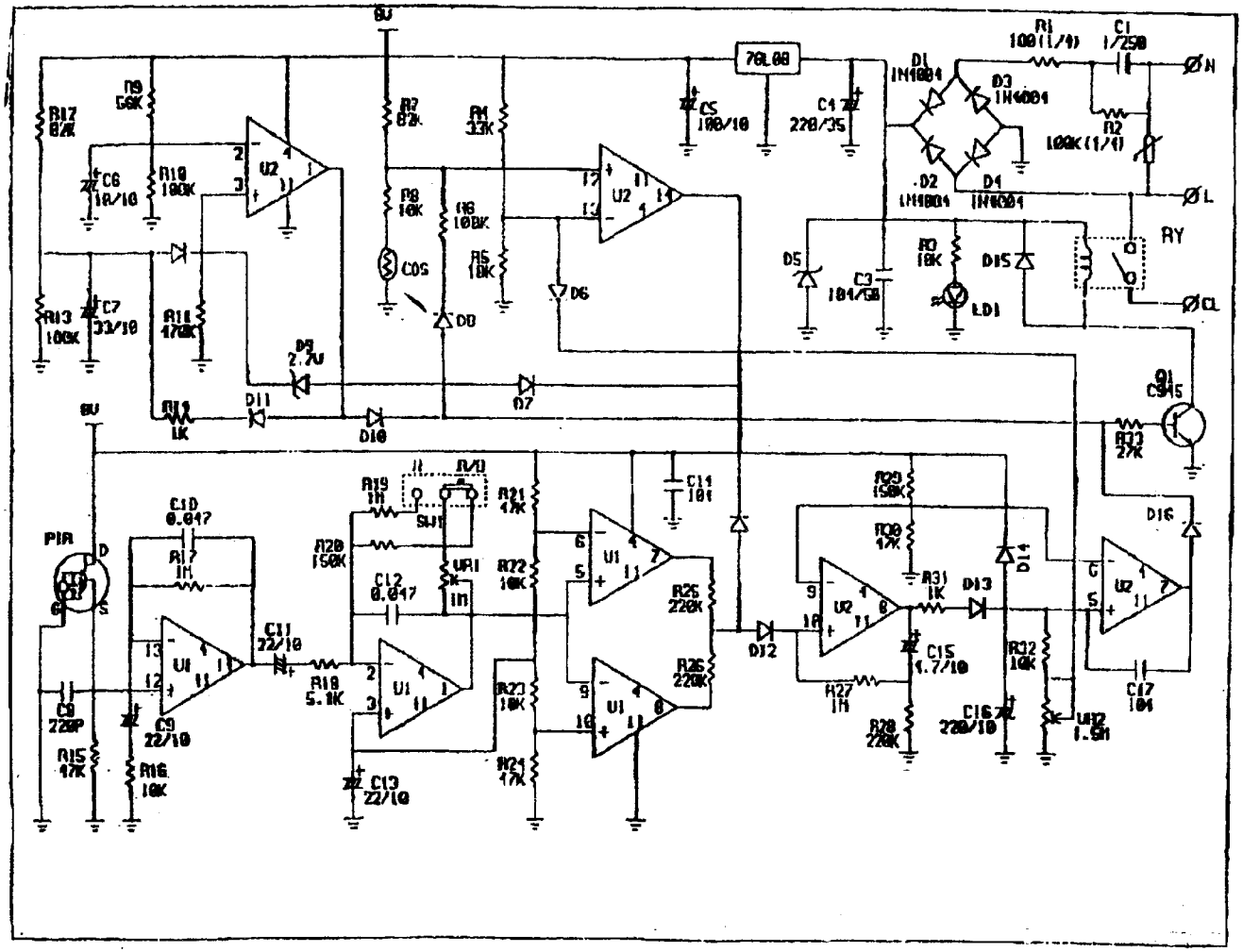
FIG. 8 is an electrical schematic of the electrical components of the invention.

FIG. 8 is an electrical schematic of the motion detector head.

In compliance with the statute, the invention described herein has been described in language more or less specific as to structural features. It should be understood, however, that the invention is not limited to the specific features shown, since the means and construction shown, comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. A motion detector head, comprising:

a. an outer housing containing a motion sensor having adjustable sensitivity and adjustable timer settings;

b. a first touch activated switch mounted on said outer housing and connected to said motion sensor to control the sensitivity of said motion sensor;

c. a second touch activated switch mounted on said outer housing and connected to said motion sensor to adjust the length of time said motion sensor is activated;

d. a first LED connected to said motion sensor that illuminates in a plurality of different colors when said first touch activated switch is used to change the sensitivity states of said motion sensor; and, e. a second LED connected to said motion sensor that illuminates in a plurality of colors when said second touch-activated switch is used to change the timer state of said motion sensor.

2. The motion detector head as recited in claim 1, further including a main switch attached to said outer housing and connected to said motion sensor used to manually set said motion sensor in a sensitivity adjustment mode or timer adjustment mode.

3. The motion detector head as recited in claim 2, further including said main switch used to manually set said motion sensor in a test mode.

4. The motion detector head as recited in claim 1 wherein said first touch-activated switch is a membrane switch.

5. The motion detector head as recited in claim 2, wherein said second touch activated switch is a membrane switch.

6. The motion detector head as recited in claim 1, wherein said first LED illuminates in three possible colors to indicate one of three possible sensitive states for said motion sensor.

7. The motion detector head as recited in claim 1, wherein said second LED illuminates in three possible colors to indicate one of three possible timer states for said motion sensor.

8. The motion detector head as recited in claim 6, wherein said second LED illuminates in three possible colors to indicate one of three possible timer states for said motion sensor.

* * * * *